United States Patent [19]

Still et al.

[11] 4,179,001

[45] Dec. 18, 1979

[54] UNDERGROUND DRILLING AND CASING METHOD AND APPARATUS

[76] Inventors: Norman H. Still, 617 Brookwood; Robert W. Berry, Jr., 1566 N. Wardman, both of Brea, Calif. 92621

[21] Appl. No.: 836,219

[22] Filed: Sep. 23, 1977

[51] Int. Cl.[2] ..... E21D 3/00; E21B 19/00

[52] U.S. Cl. ..... 175/57; 175/94; 175/171; 175/257; 175/325

[58] Field of Search ..... 175/325, 171, 94, 57, 175/257, 258

[56] References Cited

U.S. PATENT DOCUMENTS

| | | | |
|---|---|---|---|
| 2,588,068 | 3/1952 | Williams et al. | 175/171 X |
| 2,751,203 | 6/1956 | Compton | 175/325 |
| 3,540,536 | 11/1970 | Huszak | 175/171 X |
| 3,645,343 | 2/1972 | Mays | 175/171 |
| 4,009,909 | 3/1977 | Robbins et al. | 175/94 |

*Primary Examiner*—William Pate, III
*Attorney, Agent, or Firm*—Gene W. Arant

[57] ABSTRACT

In an underground mine, a machine for drilling upwardly is placed in one tunnel of the mine and is used to drill a vertical shaft communicating with another tunnel at a higher elevation. The machine is operated so as to install a liner or casing in the shaft in a step-by-step fashion, substantially concurrently with the corresponding steps of the drilling operation.

19 Claims, 15 Drawing Figures

FIG. 2a.
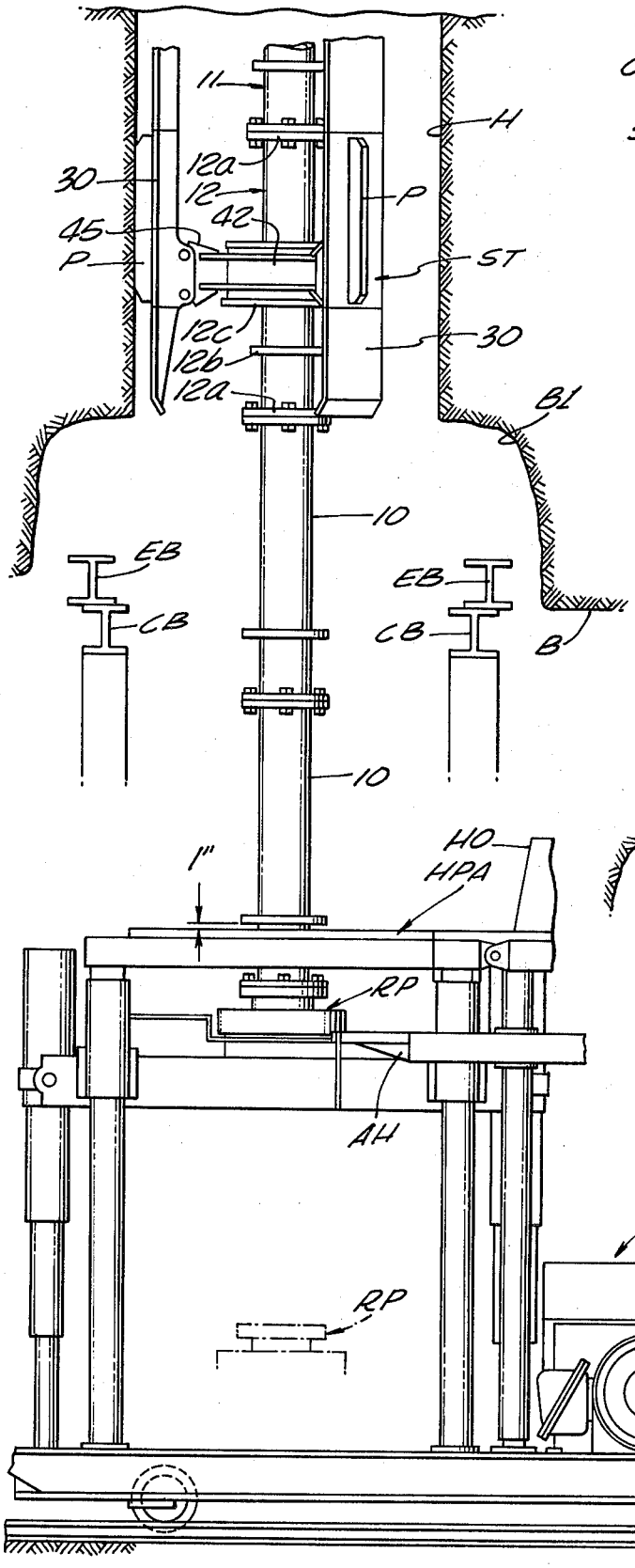
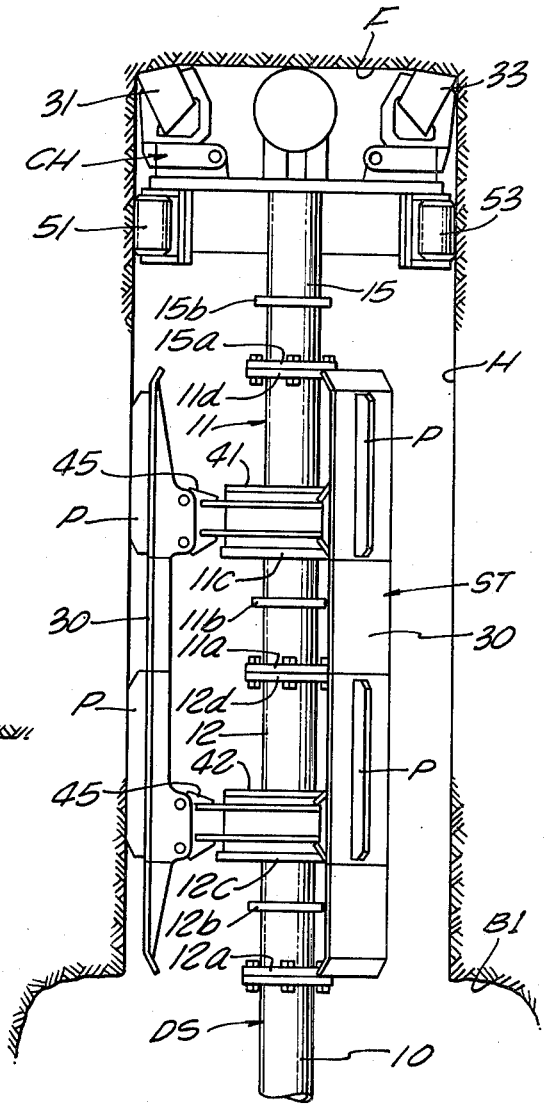
FIG. 2b.

FIG. 11a.
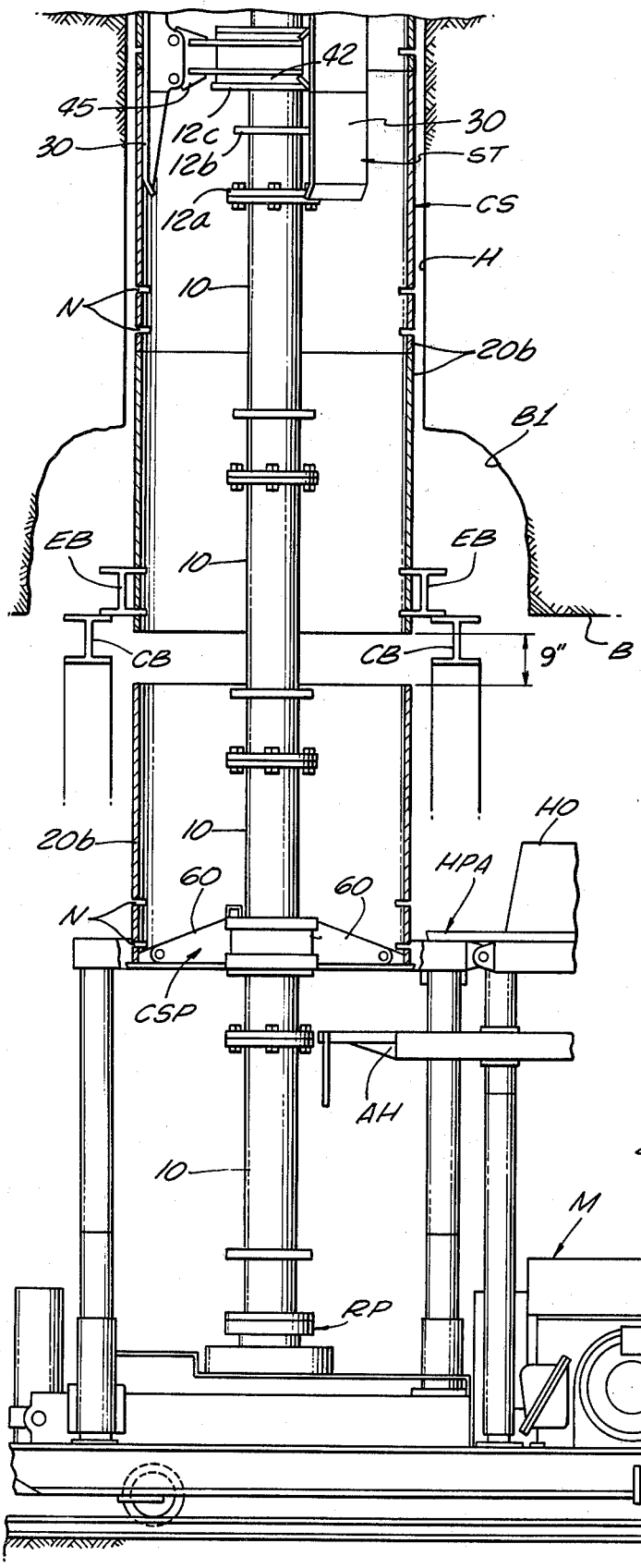
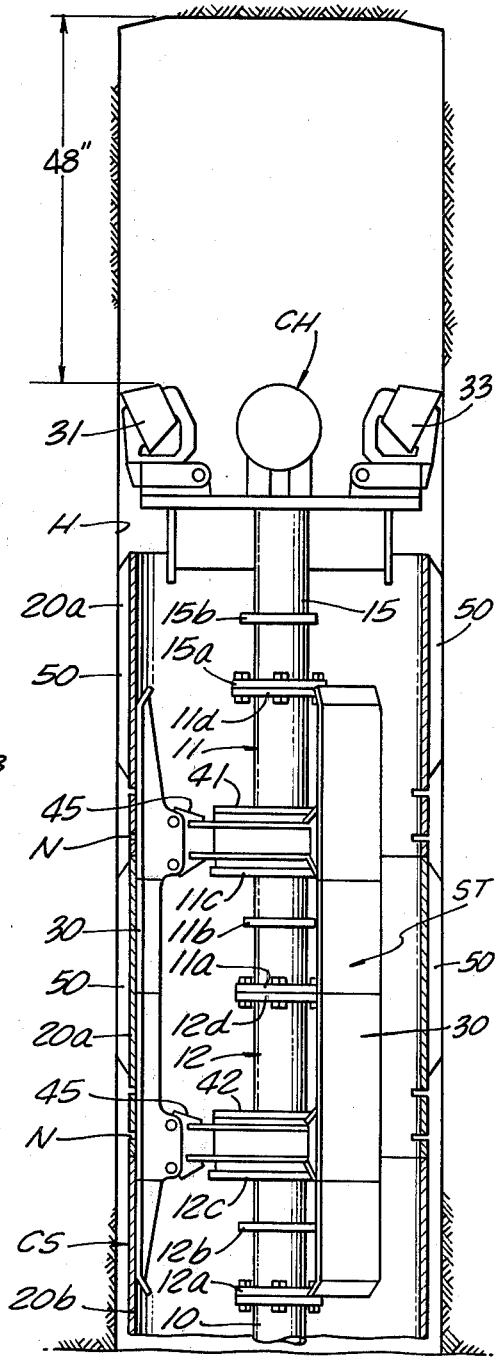
FIG. 11b.

UNDERGROUND DRILLING AND CASING METHOD AND APPARATUS

RELATED APPLICATIONS; PRIOR ART STATEMENT

Related copending patent applications include the following:

COLLAPSIBLE SPIDER FOR USE IN SUPPORTING CASING DURING UPWARD DRILLING OPERATIONS, Norman H. Still, inventor, Ser. No. 772,458 filed Feb. 28, 1977 now U.S. Pat. No. 4,133,398.

COLLAPSIBLE CUTTERHEAD FOR DRILLING UPWARD, Norman H. Still and Robert W. Berry, inventors, Ser. No. 787,283 filed Apr. 13, 1977 now U.S. Pat. No. 4,083,416.

SKI-TYPE STABILIZER FOR DRILLING APPARATUS, AND METHOD OF USE, Norman H. Still and Robert W. Berry, Jr., inventors, Ser. No. 787,284 filed Apr. 13, 1977, now U.S. Pat. No. 4,098,544.

All of the above applications are assigned to the same assignee as this present application.

To the extent that the method and apparatus herein disclosed are known to applicants to be within the scope of the prior art, that fact is so stated at pertinent points throughout this description.

BACKGROUND OF THE INVENTION

Machines for drilling upwardly, sometimes known as box hole machines, are often used in underground mining operations. In some instances the machine is used to rob ore material which then falls downwardly toward the machine. In other instances the machine is used to create a vertical communicating shaft that extends between two horizontal drifts or tunnels of the mine.

A communicating shaft must ordinarily, for safety reasons, be cased with a metal casing. It has been the practice in the past to first drill the vertical communicating shaft between the two horizontal drifts or tunnels, and then subsequently to install the metal casing within the shaft.

Some mining operations, however, are conducted in earthen material which is not supported adequately to be cut or mined in the usual manner. When drilling in this bad ground, the earthen material may flow into the shaft or hole before it can be cased. A difficult problem is then presented.

Thus, a problem known to mining operations of the prior art has been that sometimes it has not been possible to construct a cased shaft where one is desired, because the hole or shaft after it has been cut will become obstructed or clogged by the bad ground which flows into it.

The object of the invention, therefore, is to provide a method for drilling and casing a vertical hole in bad ground.

SUMMARY OF THE INVENTION

According to the present invention a method is provided for casing an upwardly extending hole substantially concurrently with the drilling thereof. More specifically, a drill string supporting a cutterhead is extended one section at a time, in a step-by-step fashion, and a liner or casing is installed in the shaft a section at a time in a similar step-by-step fashion, substantially concurrently with the corresponding steps of the drilling operation.

The present invention also provides a novel drilling machine which is adapted to accomplish a step-by-step extension of the shaft or hole, and to accomplish substantially concurrently the step-by-step extension of a liner or casing which is installed in the shaft.

Further in accordance with the invention, a novel method is provided for supporting the uppermost portion of the drill string concentrically within the uppermost portion of the casing string, and then advancing the drill string and cutterhead by a distance shorter than the concentrically supported portion so that the cutterhead continues to be supported concentrically of the casing.

Also in accordance with the invention a single mining machine located in a lower tunnel is utilized both to drive the drill string and cutterhead in a drilling action, and also to jack the casing or liner upward into the hole.

DRAWING SUMMARY

FIG. 1 is an elevational view, partially in cross-section, of a cased shaft which extends vertically between two horizontal drifts in a mine;

FIG. 2*a* is an elevational view on a larger scale of a mining machine located in the lower tunnel of FIG. 1, supporting a drill string and a stabilizer in the partially drilled shaft;

FIG. 2*b* is an elevational view of the upward extension of the shaft of FIG. 2*a*, showing a cutterhead attached to the upper end of the drill string;

FIG. 5 is an elevational view of the mining machine and lower portion of the cased shaft as upward drilling is continued, and showing the stabilizer reinstalled inside the casing;

Figure 7:
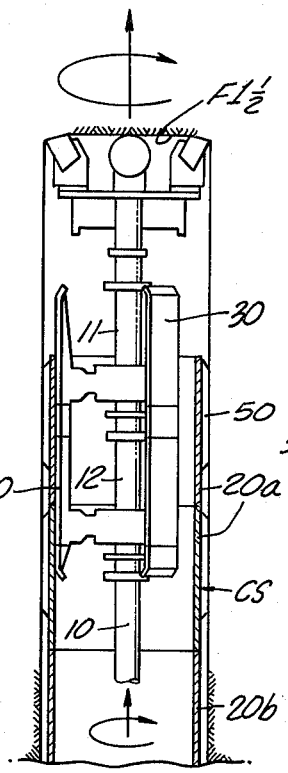
FIG. 7 is a view like FIG. 6, but showing the drill string, stabilizer, and cutterhead advanced for extending the hole upward.
Figure 12:
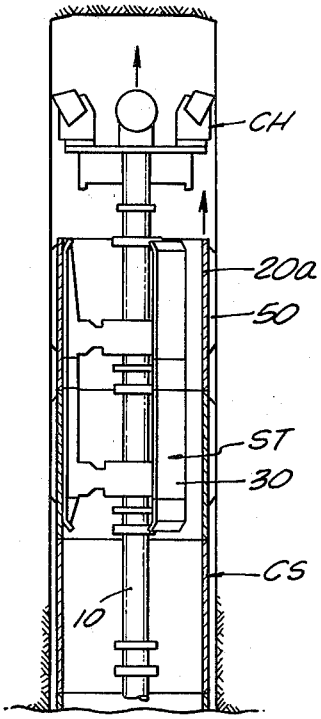
Figure 13:
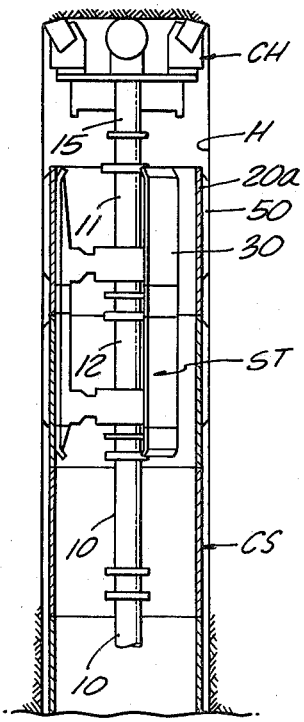

FIG. 11*a* is an elevational view shown on the same scale as FIGS. 2–5, of the mining machine and lower portion of the shaft, as a new casing section is about to be added to the casing string;

FIG. 11*b* is an elevational view of the upwardly extending portion of the drilling apparatus of FIG. 11*a*, showing its position relative to the hole and the casing;

FIG. 12 is a view similar to FIG. 7, but showing the casing string being jacked upwardly, and the drill string being concurrently jacked upwardly without rotation; and FIG. 13 is a view like FIG. 12 but showing the position of the apparatus when the casing string has been jacked upwardly by one full section length.

BACKGROUND INFORMATION

Figure 1:
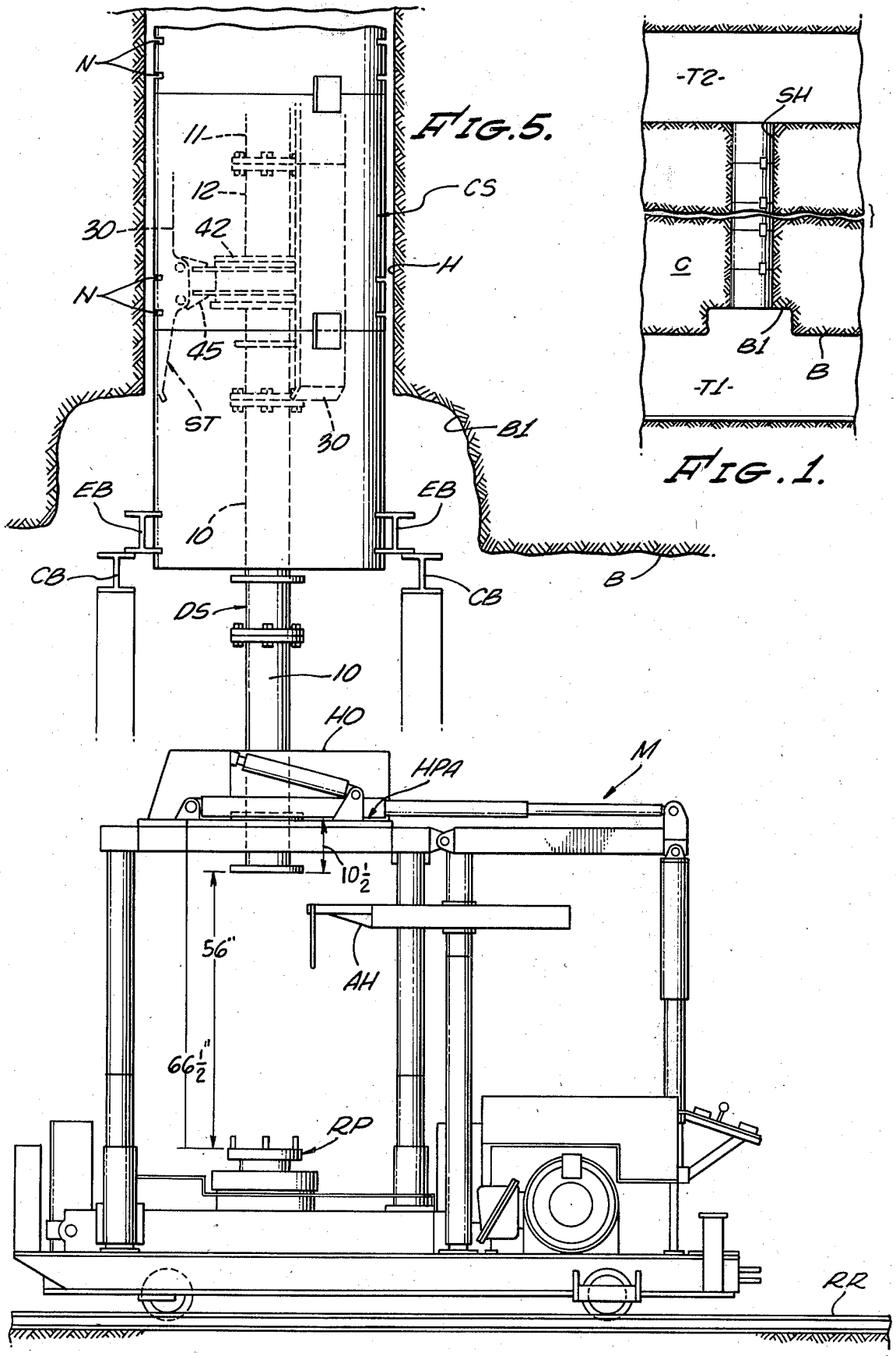

FIG. 1 illustrates a mine having a lower drift or tunnel T1 formed in the ground or earthen material G, and also an upper drift or tunnel T2. A cased shaft SH extends in a precisely vertical direction between lower tunnel T1 and upper tunnel T2. The ceiling or back B of lower tunnel T1 is upwardly recessed at B1 underneath the lower end of shaft SH.

All of the other drawing figures show various portions of the mining apparatus, in various states or operating conditions, which is utilized in carrying out the method of the present invention. A conventional mining machine M is specifically designed for drilling upwardly and is of the type sometimes referred to as a box hole machine. A drill string DS make up of a series of separate drill stem sections 10 is concurrently raised and rotated by the mining machine M in order to drive a cutterhead CH in a drilling or cutting action. While this overall general arrangement is conventional, cutterhead CH is particularly designed for collapsibility in order to be effectively utilized in carrying out the method of the present invention. The specific details of the structure and operation of the collapsible cutterhead are disclosed in copending application Ser. No. 787,283 referred to above.

Thus the mining machine cuts a hole H in a generally conventional manner. A casing string CS made up of a series of separate sections 20 is installed in the hole H in order to provide the cased shaft SH. in accordance with the present invention the installation of the casing or liner is commenced after a certain initial length of the hole H has been cut. Thereafter, additional drill string sections and additional casing sections are installed substantially concurrently. In order to carry out the purposes of the present invention a novel collapsible spider CSP shown in FIGS. 3 and 11*a* has been devised, which makes it possible for machine M to lift one or more casing sections concurrently with the drill string DS. Details of the construction and operation of the collapsible spider are set forth in copending application Ser. No. 772,458 referred to above.

According to the present invention, the step-by-step extension of the hole H and of the casing string CS which lines the hole utilizes both a novel drilling structure and a novel method or process. Specifically, a novel ski-type stabilizer ST is provided, which is carried upon drill string DS immediately below the cutterhead CH. When extending the hole, the stabilizer ST is always at least partially contained within the casing string CS, and is sometimes entirely contained therein. By virtue of the cooperative action of the stabilizer, a single machine including the cutterhead, drill string, stabilizer and casing string operates to progressively extend and progressively case the hole. Stabilizer ST and its method of operation are described in detail in copending application Ser. No. 787,284 referred to above.

In accordance with the novel method of the present invention there are unique operating steps performed by drilling apparatus located in the upper end of the hole H. There are also unique operating steps performed within the lower tunnel T1 by the machine M and its auxiliary equipment. There is, in addition, a necessary coordination of the action taking place in the tunnel T1 with the action desired in the upper end of the hole. The various portions of the mining apparatus will be described in so me detail in respective chapters or paragraphs of this description. Thereafter, the various phases of the method or process will be described in additional chapters or paragraphs, in the sequence in which they occur.

THE MINING MACHINE

Mining machine M is shown in FIGS. 2*a*, 3, 5, and 11*a*. It is of conventional construction. It includes a rotary platform RP which can be raised or lowered by a distance which is equal to the length of a section of the drill string, plus clearance distances. When utilizing drill string sections four feet in length the vertical traverse of rotary platform RP is approximately four feet nine inches. Machine M at the upper extremity of its frame is also provided with a hair pin assembly HPA. The hair pin assembly is used to selectively support the lowermost end of a drill string DS that extends upwardly into the hole H that is being cut. This support is achieved by engaging the under surface of a special flange, known as the hair pin flange, that is provided near the lower end of each drill stem section, a few inches above the lower end flange. The hair pin assembly is used to support drill string DS whenever a drill stem section is being added to or broken out from the string.

Rotary platform RP is driven hydraulically, by separate rotary and vertical drives, the details of which are not specifically shown in the present drawings. The machine operator has one control available for controlling the vertical drive, and another separate control available for controlling the rotary drive. Thus, rotary platform RP may be rotated without being elevated; or it may be elevated without being rotated; or it may be elevated and rotated at the same time.

To facilitate the insertion or break-out of a drill stem section, machine M is provided with an automatic pipe handler AH. This automatic device releives the operator of most of this labor involved in handling the drill stem sections.

LAYOUT OF THE MINE; AUXILIARY TUNNEL APPARATUS

In the particular mine as presently illustrated the lower tunnel T1 and upper tunnel T2 are first opened by conventional means, and a vertical hole H is subsequently cut between them to provide the cased shaft SH. Because of the fact that ground G of the mine does not provide adequate support for itself, it is necessary to utilize the novel apparatus and method of the present invention, in constructing the cased shaft SH.

Before the mining machine M is moved into place in the lower tunnel T1 the recess B1 is cut in the back or ceiling B of the tunnel. Location of recess B1 in the horizontal plane is determined by the desired location of cased shaft SH. The height to which recess B1 is cut is determined in part by the ability of the earthen material G to support itself, and it may also be determined in part by clearance distances required for the work that needs to be done in the tunnel. Ceiling beams CB are a part of the tunnel structure. When the recess B1 is cut a pair of elevator beams EB are also installed. As will be noted from the drawings, elevator beams EB sometimes rest upon a corresponding pair of the ceiling beams CB, but at other times may be moved laterally inward towards each other for purpose of supporting the casing string CS. Each of the elevator beams EB is an I beam, and its flanges are adapted to engage a corresponding pair of notches N formed in the lower end wall of a section of the casing or liner. Whenever the casing string CS is to be jacked upward, the elevator beams are moved laterally outward in order to disengage them from the casing.

A pair of railroad rails RR are typically provided on the floor of tunnel T1. These rails may be utilized for transporting the mining machine M to its operative position. Although not shown in the present drawings, it is actually preferred to cut a side pocket in the tunnel T1, and locate the mining machine M in that side pocket so that the railroad rails RR may continue to be used for transporting loads through the tunnel T1, even while the mining machine M is in full operation.

The cutterhead CH may be lifted onto the mining machine M in accordance with conventional practice, using any desired method. Alternatively, it may be desired to use for that purpose a special machine disclosed in the copending application of Robert W. Berry, Jr., Ser. No. 602,775 filed Aug. 7, 1975 and assigned to the same assignee as the present application.

When casing is to be installed a collapsible spider CSP is used in conjuction with the mining machine M. See FIGS. 3 and 11*a*. The construction and operation of the collapsible spider are described in detail in copending application Ser. No. 772,458 referred to above.

As the drilling operation proceeds the face F of the hole H is moved progressively upward. The hole faces F1, F1 ½, and F2 in FIGS. 6 through 8, respectively, correspond to successive steps in the continuous operation of drilling the hole while concurrently installing the casing in it.

THE DRILLING APPARATUS

(FIGS. 2*b* and 3-6)

The drilling apparatus includes the cutterhead CH mounted upon and driven by the drill string DS. It also includes the ski-type stabilizer ST carried upon the two uppermost sections of the drill string DS, immediately beneath the cutterhead. After the bit has been collared, and the hole started and aligned, the drilling apparatus working inside the hole also includes the casing string CS.

FIG. 2*b* shows the condition of the drilling apparatus when the hole has been started and aligned, and before any casing has been installed. Cutterhead CH includes a set of three gauge cutters 31, 32, 33 which bear upon the upper end face F of the hole H. These gauge cutters are pivotally supported upon brackets so that they may be collapsed inwardly when necessary. Immediately beneath the gauge cutters are corresponding stabilizer rollers 51, 52, 53, each carried on a separate bracket which may be removed from the main frame of the cutterhead. After casing is installed in the hole these stabilizer rollers may be removed from the cutterhead in order to premit it to pass longitudinally through the interior of the casing. The cutterhead also includes as its means of support, a partial drill stem 15 having a lower end flange 15*a* and a hair pin flange 15*b*. Further details of the structure and operation of the collapsible cutterhead are set forth in the copending application Ser. No. 787,283 filed Apr. 13, 1977 and which has been previously identified.

Immediately beneath the partial drill stem section 15 of the cutterhead in FIG. 2*b* are a pair of identical special drill stem sections 11, 12 which support the stabilizer ST. Drill stem section 11 has a lower end flange 11*a*, a hair pin flange 11*b*, a special bearing support flange 11*c*, and an upper end flange 11*d*. Drill stem section 12 has similar flanges 12*a* through 12*d*, respectively. Upper cylindrical bearing assembly 41 is supported upon the bearing flange 11*c*, while lower cylindrical bearing assembly 42 is supported on flange 12*c*. The stabilizer also includes upper and lower brackets 45 secured to respective ones of the bearing assemblies. A set of three longitudinally extending ski-like members or skids 30 are in turn secured to both of the brackets. As shown in FIG. 2*b* the ski-like members 30 are also equipped with removable pads P. Further details of the construction and operation of the stabilizer are disclosed in the copending application Ser. No. 787,284, filed Apr. 13, 1977 which has previously been identified.

Beneath the special drill stem sections 11, 12 the drill string DS includes a series of regular drill stem sections 10, as many as are needed. The regular drill stem sections differ from the special drill stem sections only in that the special bearing flange is omitted.

When cutterhead CH is driven upward in a drilling movement, the ski-like members 30 slide longitudinally along the wall of hole H. The bearing assemblies 41, 42 permit the drill string DS to rotate within and relative to the ski-like members. At the same time the stabilizer ST maintains. the drill string DS, and hence the cutterhead CH, concentric to the hole.

Figure 3:
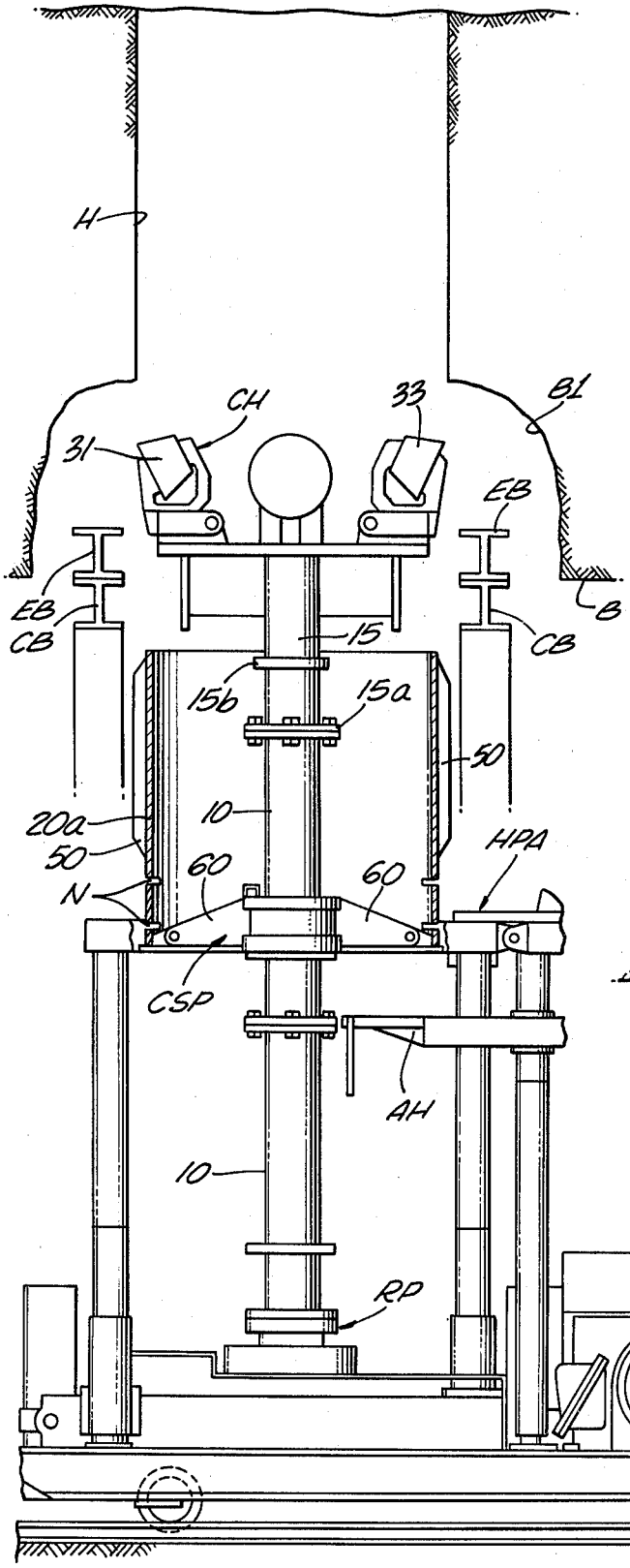
FIG. 3 is a view similar to FIG. 2*a* but showing the drill string and cutterhead withdrawn from the shaft, the stabilizer removed, and a first casing section ready to install into the shaft.

FIG. 3 shows the drilling apparatus at a later stage of the process. The cutterhead and drill string have been removed from the hole. The stabilizer ST has been detached. The stabilizer rollers have also been detached from the cutterhead. The special drill stem sections which supported the stabilizer have been removed, and have been replaced with regular drill stem sections 10. A first casing section 20*a* has been installed in the machine M. And the collapsible spider CSP is about to be used for installing the first casing section in the hole.

Figure 4:
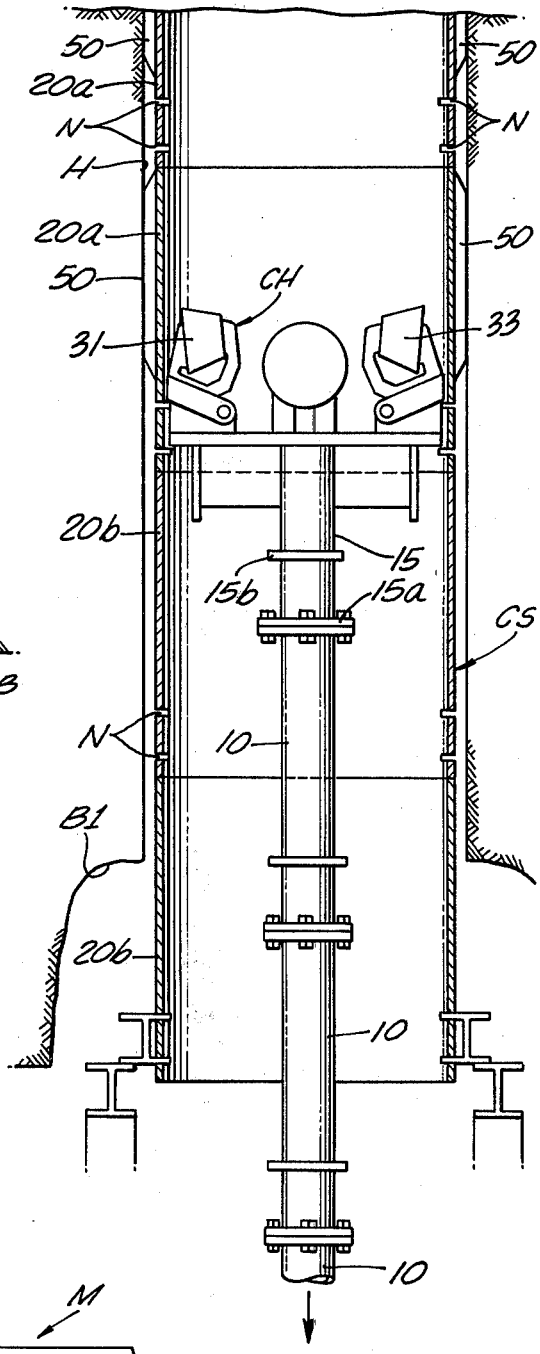
FIG. 4 is a cross-sectional elevational view of the partially drilled shaft after it has been cased, with the drill string and collapsible cutterhead positioned inside the casing.

FIG. 4 shows a still later stage in the process. An initial casing string CS has been installed in the hole, which consists of two casing sections 20*a* and two casing sections 20*b*. The drill string is shown as it is being withdrawn from the hole. The cutterhead has been collapsed so that it can pass through the interior of the casing string.

FIG. 5 shows the drilling apparatus at a still later stage of the process. The special drill stem sections 11 and 12 have again been placed in their positions immediately beneath the cutterhead. The stabilizer ST has been attached to the special drill stem sections. This time, however, the pads P are not used on the stabilizer, because the ski-like members 30 now slide along the interior wall surface of the casing string.

Figure 6:
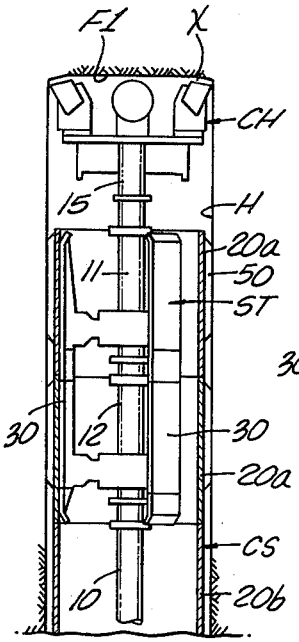
FIG. 6 is a cross-sectional elevational view, on a reduced scale relative to FIGS. 2–5, of the upper end portion of the partially drilled shaft including the casing and the drilling apparatus contained therein.

The stabilizer ST then permits achievement of a novel cooperative functioning of the drill string DS and the casing string CS. The physical arrangement of the parts of the apparatus is shown in FIGS. 6 through 13, inclusive. As shown in FIG. 6 the stabilizer ST may be fully contained within the casing string CS, the upper end of the ski-like members 30 coinciding with the upper end of the casing string. Drill string DS and cutterhead CH are then, by means of the stabilizer, supported concentrically of the casing string, but are able to move longitudinally relative to the casing string.

Figure 8:
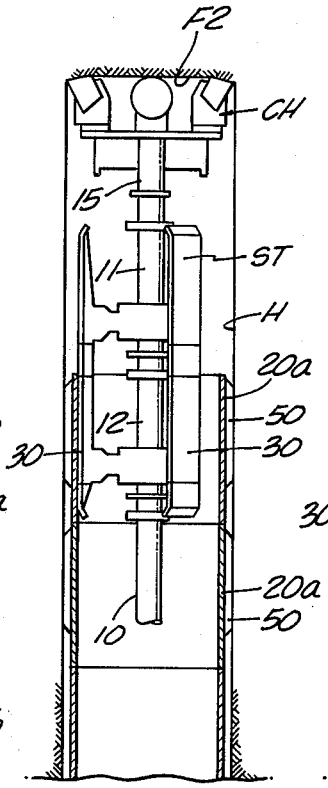
FIG. 8 is a view like FIG. 7 but showing the drilling apparatus advanced by the full length of one section of the drill string.

FIGS. 7 and 8 show positions of the apparatus in which the drill string has been raised and concurrently rotated, in order to advance the hole. Stabilizer ST remains partially supported inside the casing string but also extends partially beyond the casing string.

In this connection it is important to note the relative length of the parts. Each drill stem section 10, 11 or 12 has a standard length. Each casing section 20*a* or 20*b* has a standard length, which is preferably identical to the standard length of the drill stem sections. The length of stabilizer ST, and specifically of the ski-like members 30 thereof, is preferably equal to the length of two drill stem sections.

The significance of these length relationships is as follows. Machine M must advance the drill string by the length of one drill stem section before a new drill stem section may be added to the string. It is necessary to advance the drill string relative to the casing string by the length of one drill stem section, before advancing the casing in the hole. During this relative advancement of the drill string the stabilizer ST is extended beyond the confines of the casing string, but only by the length of one drill stem section, more or less, and its lower or rearward end therefore remains securely supported within the interior wall of the casing string.

Thus according to the present invention a novel drilling machine is provided, including the combination of a cutterhead, a drill string on whose forward end the cutterhead is supported, a ski-type stabilizer supported on the drill string below the cutterhead and whose length is substantially greater than the length of one section of the drill string, and a casing string within which the skis of the stabilizer are supported. More specifically, the length of the stabilizer is preferably about twice the length of a section of a drill string, and the casing string is made up of sections whose length is preferably identical to the length of the drill stem section.

THE START UP; OPENING AND ALIGNING THE HOLE (FIGS. 2*a* and 2*b*)

After the recess B1 has been cut in the ceiling of the lower tunnel T1 the mining machine M is then moved into place. The cutterhead CH is placed upon the machine and supported upon the hair pin assembly HPA. Upper bearing assembly 41 of the stabilizer ST is placed upon bearing flange 11*c* of the special drill stem section 11. Utilizing the automatic handler AH, the special drill stem section 11 is then placed upon the rotary platform RP of the machine.

The lower end flange 11*a* is attached to the rotary platform RP. Then the rotary platform is raised until upper end flange 11*d* engages the bottom flange 15*a* of the cutterhead. These two flanges are then bolted together. Rotary platform RP is then raised an additional distance, approximately one inch, in order to lift the hair pin flange 15*b* of the cutterhead off the hair pin assembly. The hair pin assembly is then laterally withdrawn.

Rotary platform RP is then raised another four feet, so that hair pin flange 11*b* is above the elevation of the hair pin assembly. Then the hair pin assembly is moved laterally inward underneath the flange 11*b*. Rotary platform is moved downward about one inch until the weight of the cutterhead and of drill stem section 11, including bearing assembly 41, is supported by the hair pin assembly. The lower end flange 11*a* of drill stem section 11 is then detached from the rotary platform. The rotary platform is then moved downward four feet and several inches to its lowermost position.

At this time, with special drill stem section 11 being supported above the hair pin assembly, the upper bearing assembly 41 and its upper bracket 45 are available for attachment of some parts of the ski-like members 30 thereto. Lower bearing assembly 42 is attached to the bearing flange 12*c* of the drill stem section 12, which is then installed in the machine. The previously described procedure is repeated so that the drill stem section 12 can be attached to the drill stem section 11, and the entire drill string raised until drill stem section 12 is supported by the hair pin assembly.

As described in the copending application Ser. No. 787,284, the ski-like members 30 are not integral structures but are instead formed of a series of separate sections or component parts. The various component parts of these ski-like members may be installed immediately after the drill stem section 12 is brought into the machine, or at a later time after that drill stem section has been raised up to the level of the hair pin assembly, or at an even later time in the procedure, as proves more convenient. The pads P are also attached to the ski-like members 30.

Referring to FIG. 2*a*, it will be seen that the elevation of recess B1 above the machine is such that drilling must be started when the special drill stem section 12 is being raised. Therefore, the operator not only actuates one control for lifting the rotary platform RP, but also actuates another separate control for causing the platform to rotate. As the platform is both raised and rotated, the cutterhead CH is collared in the hole.

Standard drill stem sections 10 are then installed underneath the special drill stem section 12, as many as are needed. As each such section is installed the rotary platform is raised and concurrently rotated so that cutterhead CH continues to extend the hole H upwardly. Even before stabilizer ST enters the hole, the stabilizing rollers 51–53 of the cutterhead roll in substantially helical paths around the wall of the hole, so as to maintain the cutterhead in concentrically aligned relation to the hole.

Casing sections 20*a*, 20*b* which will subsequently be used to line the hole have an exterior diameter which is preferably forty-eight inches in the present example. The diameter of hole H cut by gauge cutters 21–23 of the cutterhead is preferably 52 inches, and the stabilizer rollers 51–53 are so positioned as to roll upon the wall surface of a hole of that diameter. The reason that the hole is deliberately cut oversized for the casing or liner is that, in accordance with the present invention, it is assumed that the cased shaft SH is being constructed in bad ground. The oversized diameter of the hole, therefore, makes it possible for some flow or movement in the earthen material to take place, but without preventing the successful installation of the casing or liner.

The ski-like members 30 of the stabilizer ST are, in the present example, designed to fit within an interior diameter of about forty-seven and one-quarter inches. This is the typical interior diameter of the casing or liner. The pads P, however, give the stabilizer an effective diameter which is equal to the fifty-two inch diameter that is cut by the cutterhead. Thus the pad P will provide a positive centering action to maintain the drill string and hence the cutterhead concentric to the hole.

FIG. 2*b* shows the hole having been cut to a height sufficient to accommodate the cutterhead CH and the entire length of the stabilizer ST. This height of the hole will accommodate the first two special casing sections 20*a*. It may be preferred, however, to cut the initial opening as much as two additional section lengths before removing the apparatus from the hole in order to install the casing.

TRANSITION FROM START-UP TO CONTINUOUS OPERATION

(FIGS. 3 and 4)

After the hole has been started and aligned, several other steps are necessary before the continuous operation of drilling and concurrently casing the hole, in a step-by-step fashion, can be achieved. It is necessary to detach the stabilizer ST from the drill string, and in order to do this the entire drilling apparatus must be removed from the hole. The stabilizer rollers 51–53 are detached from the cutterhead at the same time. It is necessary to install an initial length of casing or liner in the hole. And it is also necessary to then replace the stabilizer in the drill string, but this time without the pads P being attached. These various portions of the procedure will now be described in somewhat more detail.

The drill string DS is progressively withdrawn from the hole and the standard drill stem sections 10 are detached. The procedure in breaking out each drill stem section is the inverse of the procedure for inserting it, as previously described. Then the external parts of the stabilizer ST are removed and the special drill stem sections 11 and 12 are detached. Stabilizer rollers 51–53 are also detached from the cutterhead. One standard drill stem section 10 is then installed immediately beneath the partial drill stem section 15 of the cutterhead.

The next procedure is to start installing the casing sections. The first two casing sections 20*a* are of a special type having a plurality of circumferentially spaced longitudinal ribs 50. When these special casing sections occupy the hole, ribs 50 will perform the positive centering action that was previously performed by the pads P. After the first two casing sections, all the remaining ones are the standard sections 20*b* which are the same except that they do not have the ribs 50 on them.

While the casing sections could be constructed in a plurality of circumferential sections, which are then assembled together, in accordance with the present invention it is preferred to utilize casing sections that are integrally formed as a single cylindrical member. For the special casing sections 20*a* the ribs 50 are separate members which are welded onto the cylinder. Welding tabs or end flanges may be required for longitudinally fastening adjacent casing sections together, and these tabs or flanges are also welded on as additional separate members.

When using an integrally formed steel cylinder to provide the basic part of the casing section it is necessary to install each casing section in the machine M at the same time that a drill stem section is being installed. The casing section is placed in circumdisposed relation to the drill stem section and both are moved laterally or horizontally into the machine M. When the first drill stem section 10 is installed in the machine no casing section is brought in with it. But when the second drill stem section 10 is installed, the first one of the special casing sections 20*a* is brought in at the same time. This is done preparatory to achieving the operating condition of the machine as shown in FIG. 3.

The collapsible spider CSP is then attached to the first standard drill stem section 10 that is immediately beneath the cutterhead. At this time the casing section 20*a* is still resting on the bottom of the machine. After the collapsible spider has been installed, a chain hoist, not specifically illustrated, is utilized for lifting the casing section up. The casing section is first lifted above the collapsible spider CSP whose radial arms 60 are pivoted upward. Then the casing section is lowered so that it rests upon the arms of the spider in the position as shown in FIG. 3. The structure of the collapsible spider and its method of use are described in more detail in the application Ser. No. 772,458 which has previously been identified.

The apparatus as shown in FIG. 3 is ready to lift the first casing section 20*a* up into the hole. Rotary platform RP is raised but without rotation. The cutterhead CH enters the hole and then the upper end portion of the casing section 20*a* also enters the hole above the recess B1. It will be noted that the casing section 20*a* has a pair of notches N formed near its lower end in respective sides thereof. The casing section is raised until the upper and lower ones of these notches are at the same elevation as the upper and lower flanges, respectively, of the elevator beams EB. Elevator beams EB are then moved inwardly on their supporting ceiling beams CB so as to engage the notches of the casing section.

Each succeeding casing section is brought into the machine M, concurrently with an additional drill stem section. The drill string and the casing string are therefore extended at the same rate and in equal steps. The elevator beams EB are a sufficient distance above the machine M so that spider CSP cannot be supported upon the lowermost one of the drill stem sections, but must instead be supported on the second drill stem section measuring from the bottom end of the drill string. This is in accordance with the illustration of FIG. 3.

The initial casing or liner for the hole must have a length of at least two sections, which would conform to the initial length of the hole as shown in FIG. 2*b*. Or if the initial opening of the hole is longer, the initial casing installation may include as many as four sections. FIG. 4 illustrates an initial opening of the hole which is longer than that shown in FIG. 2*b* by two section lengths, and in which four casing sections have therefore been installed. The two uppermost casing sections 20*a* are equipped with longitudinal ribs 50 that provide a positive centering action. The two lower casing sections 20*b* are not required to have the ribs.

When the intial length of casing or liner has been installed in the hole the cutterhead will then occupy a portion of the hole above the casing, as shown in FIG. 3. The stabilizer ST must now be again attached to the drill string. It is therefore necessary to withdraw the cutterhead and drill string from the hole. The cutterhead is collapsed by pivoting the gauge cutters 31–33 upwardly as shown in FIG. 4. The cutterhead can then be withdrawn downwardly through the interior of casing string CS. As the cutterhead is withdrawn downwardly, the drill stem sections 10 will be broken out from the drill string sequentially, in accordance with the same procedure as previously described. When the last one of the drill stem sections 10 has been detached from the cutterhead it will be replaced by the special drill stem section 11, which has the upper bearing assembly 41 already attached to it.

The stabilizer ST and its supporting drill stem sections 11 and 12 are again reassembled to the drill string, but this time without attachment of the pads P. The cutterhead, still in a collapsed state as shown in FIG. 4, is moved vertically upward inside the casing string or liner. Standard drill stem sections 10 are added to the string underneath the special drill stem section 12. The drilling apparatus will then assume the state or condition which is at least partially illustrated in FIG. 5, that is, stabilizer ST is fully assembled and is located entirely inside the casing string CS. Hopper Ho is shown in FIG. 5 in its collapsed or lowered position.

While it has been stated that during this transition procedure it is necessary to remove the special drill stem sections 11 and 12 from the drill string, that may not in fact be required. It may be possible to support the collapsible spider CSP from hair pin flange 11*b* of the drill stem section 11, and in that case it is only necessary to remove the drill stem section 12 and to replace it at the same time that the first casing section is brought into the machine. When the second casing section is brought into the machine, the collapsible spider will then be supported on hair pin flange 12*b* of drill stem section 12.

DRILLING AND CONCURRENTLY CASING—THE CONTINUOUS OPERATION

(FIGS. 6–13)

FIG. 6 illustrates an assumed position that the drilling apparatus will occupy in the upper end of the hole, when the transition has been completed and the continuous drilling and casing operation is going to be commenced. It should be noted that this is a hypothetical starting position, and the actual starting position may differ somewhat from it.

In the hypothetical position of the drilling apparatus as shown in FIG. 6, the entire cutterhead CH extends above the upper end of the casing string CS. That is, the lower end of the partial drill stem section 15 of the cutterhead is located at the upper end of the casing string. The ski-like members 30 of stabilizer ST then extend from the upper end of the casing string to the lower end of the second casing section. It will be noted that there is also a short vertical space X between the gauge cutters of the cutterhead and the upper end face F1 of the hole.

The reason for space X is that the cutterhead previously drilled in engagement with the hole face F1, but then a drill stem section at the lower end of the drill string was rested upon the hair pin assembly HPA of machine M, causing the entire drill string to sag downwardly about one inch. The position of the lower end of the drill string, and of machine M, may then be as shown in FIG. 5, namely, rotary platform RP has been lowered and there is no drill stem section resting upon it. When a new drill stem section is attached to the drill string the machine M then has the capacity for continuing the upward drilling by the length of one drill stem section.

The next step in the process is shown in FIG. 7 where the drill string has moved up by one-half the length of a drill stem section. The casing string or liner CS remains in place in the hole and does not move. The drill string DS is being raised and rotated at the same time, as indicated by the combination of a vertical arrow and a circular arrow in the drawing. These combined motions of the drill string produce a drilling action by the cutterhead CH on the tunnel face, which at this higher elevation is now designated F1 ½.

FIG. 8 shows the hole extended even further, to a distance equal to one length of drill stem section, and the face of the hole is now cut to a higher elevation designated as F2. It will be noted that in this position of the apparatus one-half of the length of the stabilizer ST extends above the casing string CS, while the other half is contained therein. The structure of the stabilizer and the mode of its support from the drill string are such that this amount of longitudinal support from the wall of the casing string is adequate to provide a reliable centering action of the upper end portion of the drill string and hence also for the cutterhead.

Figure 9:
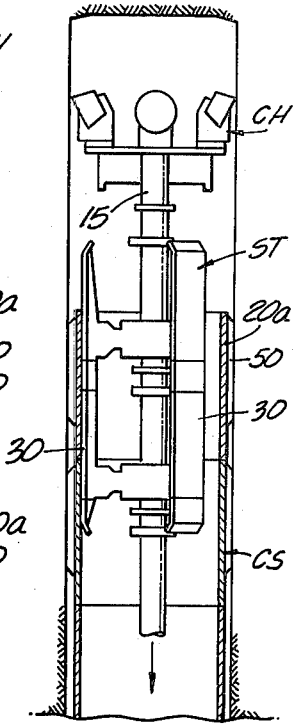
FIG. 9 is a view like FIG. 8 but showing the drilling apparatus partially retracted after cutting the extended portion of the hole.

FIG. 9 shows the next step, when the drill string and cutterhead are being retracted downwardly. Since no drilling is involved, the drill string is simply pulled downwardly as indicated by the arrow.

Figure 10:
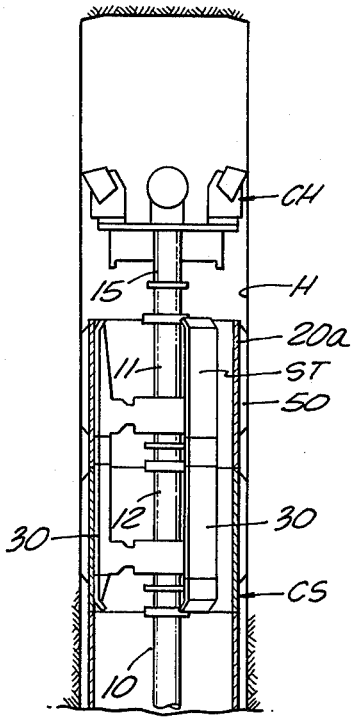
FIG. 10 is a view like FIG. 9 but showing the drilling apparatus fully retracted to the position that it had occupied in FIG. 6, before the hole was extended.

FIG. 10 illustrates the condition of the apparatus when the drill string has been retracted to the position it had occupied in FIG. 6. The position of the apparatus is the same as in FIG. 6 but the length of the hole above the apparatus is equal to one section length of the drill string more than it was in FIG. 6.

FIG. 12 illustrates the next operating step as it relates to the drilling apparatus contained within the upper end of the hole. At this time both the casing string and the drill string are being jacked upwardly and in unison. One upward arrow indicates the movement of the casing string and another upward arrow indicates the movement of the cutterhead and drill string. The upper end of the stabilizer ST is coterminous with the upper end of the casing string CS, just as it was in FIGS. 6 and 10, because both the drill string and the casing string have moved upward by the same distance. In order for the action shown in FIG. 12 to take place it is necessary that another casing section has been attached to the lower end of the casing string, down inside the lower tunnel T1. That procedure is not specifically shown either in FIG. 10 or in FIG. 12 but is specifically illustrated in FIGS. 11*a* and 11*b*. The detailed description of those figures will, however, be reserved for a later point in this chronology.

FIG. 13 shows the position of the drilling apparatus after the drill string and casing string have been jacked upward by one full section length. There is no vertical gap between the gauge cutters and the end face F2 of the hole, because it is assumed here that the drill string has not yet been rested down upon the hair pin assembly.

Attention is now redirected to the hypothetical nature of the illustration shown in FIG. 6. The relative longitudinal positions of the drill string and the casing string are determined not only by what is desired to take place in the upper end portion of the hole, but also by the condition of the apparatus in the lower tunnel T1. Reference is now made to FIGS. 5 and 11*a* to further describe this topic. As previously explained, it is greatly preferred that the drill string DS be made up of drill stem sections of standard length, and it is also greatly preferred that the casing string CS be made up of standard sections of the same standard length. The vertical starting point for the lower end of the drill string is determined by the position of machine M. The vertical starting point of the casing string is determined by the vertical position of the elevator beams EB. The relative positions of the drill string and the casing string, however, is determined primarily by the spider CSP and its placement on the drill string.

In the presently conventional version of the mining machine M the length of a drill stem section is four feet and the vertical traverse of the rotary platform is about four feet nine inches. The machine M is also characterized by the fact that the hair pin assembly HPA is located at a fixed elevation in the machine.

The height of the elevator beams EB relative to machine M is subject to some choice or selection, but not an unlimited choice. For the particular height of the elevator beams as shown in FIG. 5 each drill stem section is about twenty inches or three-tenths of a section length lower than the corresponding section of the casing string, when the drill string is supported on the hair pin.

In FIG. 11*a* the height of the elevator beams EB relative to machine M is the same as shown in FIG. 5. FIG. 11*b* illustrates the position of the drilling apparatus in the upper portion of the hole which corresponds to the position of the machine and elevator beams as shown in FIG. 11*a*. As shown in FIG. 11*b* the cutterhead CH does not extend entirely above the casing string but is partially contained therewithin. Rotary platform RP may be raised nine inches to attach new casing section 20*b* to the casing string (FIG. 11*a*). It may then be raised another four feet to jack the casing string while concurrently raising the drill string (FIGS. 12 and 13). During this latter movement the top of stabilizer ST remains about eleven inches below the top of the casing string. In the extreme upper position of the drill string and stabilizer, less than half the length of the stabilizer will remain unsupported by the casing string, and hence the rigidity and precision of the concentric support for the drill string is even better than that illustrated in the hypothetical illustration of FIGS. 8 and 13.

FIGS. 11*a* and 11*b* specifically illustrate the step of the process which must take place after the step corresponding to FIG. 10 and prior to that corresponding to FIG. 12. When the drill string was drawn downwardly to the position shown in FIG. 10 it was necessary to then remove the bottom one of the drill stem sections 10. The drill stem section must be removed so that the next casing section 20*b* can be brought into the machine. The casing section is placed in circumdisposed relation to the drill stem section that was just removed, and the two sections are moved laterally at the same time into the machine. The same drill stem section that was just removed is then reattached to the drill string. Then the collapsible spider is installed on the second from bottom drill stem section, the chain hoist is used to raise the new casing section, and the new casing section is then lowered onto the collapsible spider. The condition of the apparatus is then as shown in FIG. 11*a*. The rotary platform RP is then raised so that the new casing section may be welded or otherwise attached to the preexisting casing string. Elevator beams EB are then laterally withdrawn and the rotary platform is raised an additional distance corresponding to the length of one standard section of the casing string. This last upward movement of the rotary platform achieves the jacking action as shown in FIG. 12 and which culminates when the apparatus in the hole arrives at the position corresponding to FIG. 13.

After the apparatus arrives at the FIG. 13 position, the elevator beams EB are moved laterally inward so as to lock the augmented casing string in its new position. Then the lowermost drill stem section of the drill string is rested upon the hair pin flange. This causes a small gap to appear above the cutterhead, the same as shown in FIG. 6. The apparatus is then in the same condition as shown in FIG. 6 except that the hole has been lengthened by one section length, from the F1 height to the F2 height. The entire sequence illustrated by FIGS. 6 through 13, inclusive will then be repeated in order to extend the hole to the F3 level. Additional one-section stabilizers with skids are added to the drill string about every twenty-five feet.

After the FIG. 13 position is reached the drill string is again extended by adding another drill stem section 10 at its lower end. No casing section is added at this time. The newest drill stem section is needed in order to extend the drilling action upward by one section length corresponding to that shown in FIGS. 7 and 8.

Some further explanation is needed in order to clearly set forth the method of introducing casing sections into the machine. During the transition procedure as illustrated in FIGS. 3–5 it is not necessary to remove a drill stem section in order to be able to add a casing section. A new drill stem section and a new casing section are added together, both at the same time. The drill string and the casing string are progressively lengthened, concurrently and by equal steps. This action continues until the full initial length of the hole has been cut. Then the entire drill string is withdrawn and broken down, for the reasons previously explained. But the procedure for continuously drilling and concurrently casing the hole, as described in conjunction with FIGS. 6–13, is different. The drill string is extended relative to the casing string in order to extend the hole, and is then drawn back to its starting position. The lowermost drill stem section of the string, which was essential for the purpose of drilling the extended portion of the hole, is now in the way of introducing the new casing section into the machine. So the lowermost drill stem section is removed, the casing section is placed about it, and then the same drill stem section is reinstalled. It is true that another drill stem section will be added before the next casing section is added, but this is done subsequent to the completion of the jacking operation, represented by FIG. 13.

MODIFICATIONS

Many modifications in the illustrated method and apparatus may be made within the scope and spirit of the present invention. For example, under the heading "XI. TRANSITION" it has been stated that the special drill stem sections 11 and 12 should be removed and replaced with regular drill stem sections 10, in order to support the collapsible spider for installing sections of the casing. However, by modifying specific details of the spider or the special drill stem sections, or both, it is possible to support the casing sections directly from the special drill stem sections, which then need not be removed.

As a further example, FIGS. 11*a* and 11*b* show a certain relative position of the drill stem sections relative to the casing string sections. However, a modified form of the collapsible spider may be utilized, which will attach to a different location on the drill stem, thereby altering the relative positions of drill string section and casing string section during the upward jacking operation.

In machine M as presently illustrated the hopper Ho is integrally formed with the hair pin assembly. In the present machine the positions of hair pin assembly, hopper, and casing string section are interdependent. The casing string section cannot be permitted to occupy space that is required for the hair pin assembly or for the hopper. However, by modifying the machine to place the hopper at about the level of the rotary platform as an accessory thereto, it will be possible to introduce each new casing section concurrently with a drill stem section, and avoid the present procedure of removing a drill stem section from the machine and subsequently replacing the same section back in the machine.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. Underground drilling apparatus comprising:

a drill string;

a casing string disposed about said drill string;

a collapsible cutterhead attached to the forward end of said drill string, said cutterhead having a normal diameter which is significantly greater than the exterior diameter of said casing string, and having a collapsed diameter which is smaller than the interior diameter of said casing string;

the forward end of said casing string having a plurality of circumferentially spaced external ribs thereon, the effective diameter of said ribs being substantially equal to the normal diameter of said cutterhead; and means for supporting and stabilizing said drill string within said casing string in concentric relation therewith, including skid means adapted to slide longitudinally within the interior surface of said casing string, and rotating bearing means secured to said drill string and to said skid means for supporting said skid means from said drill string in rotatable relationship to the longitudinal axis thereof;

whereby said drill string may be advanced relative to said casing string and concurrently drivingly rotated so as to cause said cutterhead to drill a hole, or alternatively, said cutterhead may be collapsed and said drill string may be retracted through said casing string so as to withdraw said cutterhead therethrough.

2. Underground drilling apparatus as claimed in claim 1 which includes three skids located in circumferentially spaced positions about said drill string.

3. Underground drilling apparatus as claimed in claim 1 wherein said drill string includes a plurality of longitudinal sections, said casing string includes a plurality of longitudinal sections, and said sections are of equal length.

4. Underground drilling apparatus as claimed in claim 1 wherein said rotating bearing means includes two separate rotating bearings located at longitudinally spaced positions on said drill string.

5. Underground drilling apparatus as claimed in claim 1 wherein said drill string includes a plurality of longitudinal sections, said rotating bearing means includes two separate rotating bearings carried upon corresponding ones of said sections, and said skids are of such length as to be substantially coterminous with said two sections.

6. Underground drilling apparatus comprising:

a drill string;

a cutterhead attached to the forward end of said drill string, said cutterhead being collapsible, having a normal diameter which is at least equal to the exterior diameter of said casing string, and being collapsible to a diameter which is smaller than the interior diameter of said casing string;

a casing string circumdisposed about said drill string;

means for positioning and stabilizing said drill string in concentric relation within said casing string;

removable support means adapted to drivingly support said casing string from said drill string; and a single drive means adapted to be selectively coupled to the rearward end of said drill string, said drive means being selectively operable when said support means is in place to concurrently advance said casing string and said drill string without rotation of either, and also being selectively operable when said support means is not in place to drivingly rotate said drill string while concurrently moving it longitudinally relative to said casing string.

7. Underground drilling apparatus comprising:

a drill string;

a cutterhead attached to the forward end of said drill string, said cutterhead having a normal cutting diameter;

a casing string disposed about said drill string and having an exterior diameter which is significantly smaller than said normal cutting diameter;

means for supporting and stabilizing said drill string within said casing string in concentric relation therewith;

said casing string also having a plurality of longitudinally extending ribs secured to the exterior surface of the forward end thereof in circumferentially spaced positions thereon, the effective exterior diameter of said ribs being substantially equal to the normal cutting diameter of said cutterhead; and a single drive means adapted to be selectively coupled to the rearward ends of said drill string and said casing string, said drive means being selectively operable either to concurrently advance said casing string and said drill string without rotation of either, or to drivingly rotate said drill string while concurrently moving it longitudinally relative to said casing string.

8. Underground drilling apparatus comprising:

a drill string;

a cutterhead attached to the forward end of said drill string;

a casing string circumdisposed about said drill string;

means for positioning and stabilizing said drill string in concentric relation within said casing string including skid means adapted to slide longitudinally within the interior surface of said casing string, and rotating bearing means carried on said drill string and coupled to said skid means for supporting same in rotatable relation to the longitudinal axis of said drill string;

removable support means adapted to drivingly support said casing string from said drill string; and a single drive means adapted to be selectively coupled to the rearward end of said drill string, said drive means being selectively operable when said support means is in place to concurrently advance said casing string and said drill string 9. In the art of underground drilling, the method of casing a hole substantially concurrently with the drilling thereof, comprising the steps of:

selecting a drill string having a cutterhead that is attached to the forward end thereof;

rotatably driving and concurrently advancing the drill string so as to cause the cutterhead to cut an initial length of the hole;

selecting a casing string;

inserting the casing string into the hole behind the cutterhead and around the drill string;

again rotatably driving and advancing the drill string in order to further extend the hole, while leaving the casing string in place;

then retracting the drill string and cutterhead to about the position they had occupied after the initial length of the hole had been cut; and thereafter driving the casing string and drill string forward in unison, but without rotation of either, until the cutterhead again occupies the forward end of the extended hole.

10. The method of claim 9 which includes the additional steps of thereafter again advancing and rotating the drill string in order to again extend the hole, retracting the drill string, and then again advancing the drill string and casing string in unison.

11. In the art of utilizing an underground mining machine for driving a drill string to drill a hole, and also driving a casing string to case the hole, the method of introducing additional drill stem sections and casing sections into the machine so that drilling and casing can proceed substantially concurrently, comprising the steps of:

rotatably driving the drill string and concurrently advancing it by one section length, while leaving the casing string in place, so as to extend the hole by one section length;

thereafter retracting the drill string by one section length;

then detaching the last drill stem section from the rearward end of the drill string;

thereafter placing a casing section in circumdisposed relation to the newly detached drill stem section;

then moving both the casing section and the drill stem section into the machine;

then reattaching the drill stem section to the drill string; and finally utilizing the machine, with drill string attached thereto, to advance the newly introduced casing section.

12. In the art of underground drilling, the method of stabilizing a drill string during drilling and casing operations, comprising the steps of:

selecting a drill string having a cutterhead attached to the forward end thereof;

selecting a stabilizer having an exterior diameter which is substantially less than the diameter of said cutterhead;

rotatably mounting said stabilizer upon said drill string rearwardly of said cutterhead;

removably attaching a plurality of spacing pads in circumferentially spaced positions upon the external surface of said stabilizer, so that the augmented diameter of said stabilizer is substantially equal to that of said cutterhead;

rotatably driving and concurrently advancing the drill strings so that the cutterhead cuts the hole, and the stabilizer advances into the hole and stabilizes the position of the drill string therein;

subsequently retracting the stabilizer from the hole and removing the spacing pads therefrom;

then inserting a casing into the hole; and thereafter reintroducing the stabilizer into the interior of the hole to operate inside the casing.

13. In the art of drilling and casing an underground hole, the method of stabilizing a drill string in both the uncased hole and the cased hole, comprising the steps of:

selecting a stabilizer having longitudinal skids forming an exterior surface whose diameter corresponds to that of the cased hole;

securing removable pads upon the external surfaces of the skids to provide an effective stabilizer diameter which conforms to that of the uncased hole;

rotatably mounting said stabilizer, with removable pads thereon, upon the drill string;

operating the drill string, and stabilizer with pads thereon, in the uncased hole;

then withdrawing the stabilizer from the uncased hole, and removing the pads from the stabilizer;

again rotatably mounting the stabilizer upon the drill string; and subsequently operating the drill string and stabilizer inside the cased hole.

14. In the art of drilling an upwardly extending hole by utilizing a box hole machine located beneath the lower end of the hole to raise and rotatingly drive a drill string which supports a cutterhead, and also to drive a casing string upwardly into the hole after it has been drilled, the method of casing the hole substantially concurrently with the drilling thereof, comprising the steps of:

utilizing the drill string, with cutterhead thereon, to drill an initial length of the hole;

inserting the casing string into the hole behind the cutterhead;

extending the drill string so as to extend the hole by a distance equal to the length of one drill string section;

lowering the drill string and removing the lowermost section thereof;

placing a new casing section in circumdisposed relation to the removed drill string section, and then transporting the combination thereof in a horizontal direction back into the machine and beneath the drill string;

replacing the just-removed drill string section in the drill string, and securing the drill string in the machine;

elevating the new casing section relative to the machine until it is circumdisposed about the next to lowermost drill stem section, and then securing it in that position relative to the drill string;

raising the machine, without rotation thereof, so as to drive both the drill string and the casing string upwardly in the hole by a distance corresponding to the length of the added casing section;

releasing the securement of the added casing section to the drill string;

adding an additional section to the lowermost end of the drill string and securing the augmented drill string to the machine; and then raising and drivingly rotating the drill string so that the cutterhead will further extend the upward end of the hole, while the augmented casing string remains in place.

15. In the art of drilling an underground hole in an upwardly direction by utilizing a drill string having a cutterhead on its upward end, and installing a casing string in the hole, the improved method comprising the steps of:

securing the casing string to the drill string to be supported thereby;

then raising the lower end of the drill string so as to advance the casing string and the drill string concurrently through a step of upward movement into a previously cut portion of the hole, but without rotation of the drill string or cutting action of the cutterhead;

thereafter releasing the support of the casing string from the drill string; and then rotatably driving the drill string while concurrently advancing it relative to the casing string through another step of upward movement so as to extend the hole.

16. The method of claim 15 wherein the drill string and the casing string are selected to be of sectioned construction, with the casing string sections being of identical length to the drill string sections, and wherein one step of forward movement is approximately equal to the length of one of said sections.

17. The method of claim 1 which includes the additional step of subsequently retracting the drill string through one step of movement, so that the drill string and casing string may again be concurrently advanced.

18. The method of claim 16 which includes the additional step of subsequently retracting the drill string through one step of movement, so that the drill string and casing string may again be concurrently advanced.

19. In the art of utilizing a drill string having a cutterhead on its forward end for drilling an underground hole in the upward direction, and a casing string for casing the hole, both the drill string and the casing string being of selectioned construction with the casing string sections being of identical length to the drill stem sections, the improved method comprising the steps of:

first securing the casing string to the drill string to be supported thereby;

then raising the lower end of the drill string so as to advance the casing string and the drill string concurrently through a step of upward movement which is approximately equal to the length of one of the sections, but without rotation of the drill string or cutting action of the cutterhead;

then releasing the securement of the casing string to the drill string;

thereafter rotatably driving the drill string while concurrently advancing it relative to the casing string through another step of upward movement so as to extend the hole; and finally retracting the drill string through one step of downward movement so that the drill string and the casing string may again be concurrently advanced upwardly.

* * * * *